United States Patent [19]

Hwang

[11] Patent Number: 5,044,534

[45] Date of Patent: Sep. 3, 1991

[54] COLLAPSIBLE MULTI-PIECE GARMENT HANGER

[76] Inventor: Ching-Ian Hwang, No. 181, Jang-Shoei Rd., Jang-Hua, Taiwan

[21] Appl. No.: 507,315

[22] Filed: Apr. 5, 1990

[51] Int. Cl.[5] ..... A47G 25/40; A47G 25/14

[52] U.S. Cl. ..... 223/94; 223/92; 223/89; 223/85; 211/118; D6/315

[58] Field of Search ..... 223/89, 88, 94, 92, 223/85; D6/315, 318; 211/113, 118

[56] References Cited

U.S. PATENT DOCUMENTS

| | | | |
|---|---|---|---|
| 886,041 | 4/1908 | Dawson | 223/94 |
| 1,955,995 | 4/1934 | Wood | 223/89 |
| 2,605,942 | 8/1952 | Warren et al. | 223/89 |
| 3,834,598 | 4/1974 | Matsumoto | 223/89 |
| 4,645,106 | 2/1987 | Pawl | 223/94 |

FOREIGN PATENT DOCUMENTS

| | | | |
|---|---|---|---|
| 42560 | 3/1926 | Norway | 223/94 |
| 1421 | of 1902 | United Kingdom | 223/94 |
| 711464 | 3/1954 | United Kingdom | 223/94 |

*Primary Examiner*—Werner H. Schroeder
*Assistant Examiner*—Bibhu Mohanty
*Attorney, Agent, or Firm*—Morrison Law Firm

[57] ABSTRACT

A collapsible hanger being diversified in function and having a reduced collapsed length is designed. The hanger includes a first upper piece having a first upper engaging end and an opposite first lower engaging end, a second upper piece having a second lower engaging end and an opposite second upper engaging end limitedly pivotally connected to the first upper end, a first lower piece having a first connecting end and an opposite second connecting end limitedly pivotally connected to the first lower end, a second lower piece having a first joining end and an opposite second joining end limitedly pivotally connected to the second lower end, and a hook member connected to the first and second upper ends.

9 Claims, 4 Drawing Sheets

COLLAPSIBLE MULTI-PIECE GARMENT HANGER

BACKGROUND OF THE INVENTION

The present invention relates to a hanger, and more particularly to a collapsible hanger.

A conventional collapsible hanger includes a plurality of constituent straight pieces, a chain for connecting relevant straight pieces and a plurality of connectors, respectively, for connecting together relevant straight pieces so that when the connectors are disengaged from the relevant straight pieces, the hanger can be collapsed. Such a hanger is disadvantageous in that the connectors need be separately reserved when the hanger is collapsed and the hanger has a single function.

SUMMARY OF THE INVENTION

It is therefore on object of the present invention to provide a collapsible hanger having diversified functions and that is capable of being neatly collapsed.

According to the present invention, a collapsible hanger includes a first upper piece having a first upper engaging end and an opposite first lower engaging end, a second upper piece having a second lower engaging end and an opposite second upper engaging end limitedly pivotally connected to the first upper end, a first lower piece having a first connecting end and an opposite second connecting end limitedly pivotally connected to the first lower end, a second lower piece having a first joining end and an opposite second joining end limitedly pivotally connected to the second lower end, and a hook member connected to the first and second upper ends.

The present invention may best be understood through the following description with reference to the accompanying drawings, in which like reference numerals designate the same elements.

DETAILED DESCRIPTION OF THE PREFERRED EMBODIMENT

Figure 2:
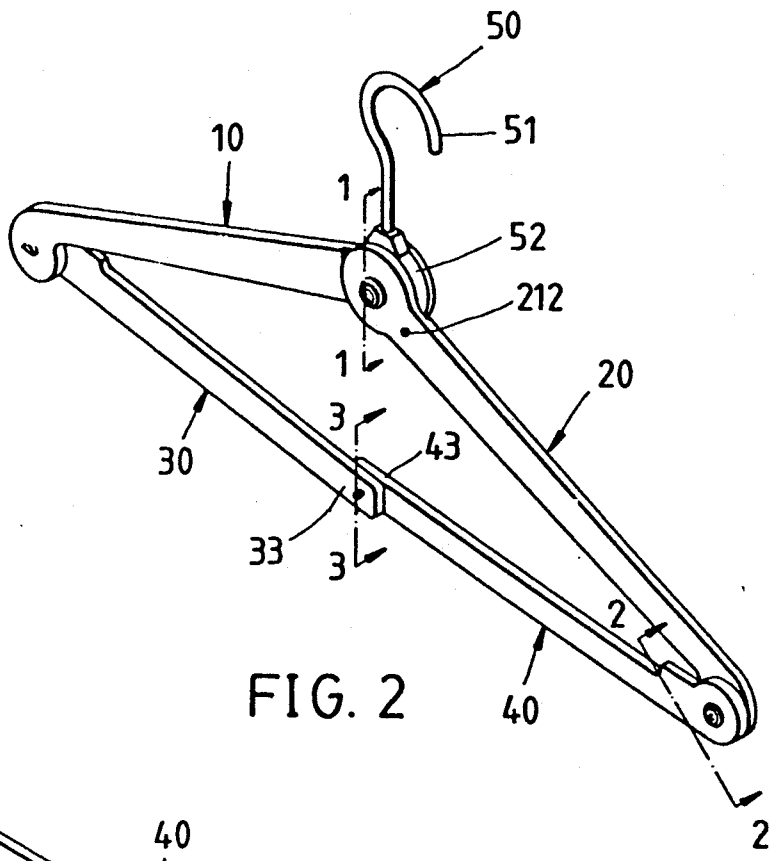
FIG. 2 is a perspective view of a collapsible hanger in FIG. 1.

Referring now to FIGS. 1 through 2 and 6 through 8, a collapsible hanger according to the present invention includes a first upper piece 10, a second upper piece 20, a first lower piece 30, a second lower piece 40 and a hook member 50. First piece 10 includes an elongate body 11 having a side surface 111 with an identation 112, an upper engaging end 12 having one side surface thereof 121 provided with a crossectionally circular raised portion 122 which includes a central projection 123, a C-shaped groove 124 having two ends 126, 127 and a peripheral recess 125, and a lower engaging end 13 which has a first side surface 131 having a central projection 132 and a protrusion 133 and an opposite side surface 134 having a central protrusion 135.

Upper piece 20 includes an elongate body 21 having a side surface 211 with an indentation 212, an upper engaging end 22 having a central through hole 222 and at one side surface thereof 221 a protrusion 223, and a lower engaging end 23 which has a first side surface 231 having a central projection 232 and a protrusion 233 and an opposite side surface 234 having a central protrusion 235.

Lower piece 30 includes an elongate body 31, a first connecting end 33 having a first side surface 331 having a recess 332 and an opposite side surface 333 having a lug 334, and a second opposite connecting end 32 having a through hole 322 and on one side surface of 321 a C-shaped groove 323 having two ends 324,325.

Lower piece 40 includes an elongate body 41, a first joining end 43 having a first side surface 431 with a protrusion 433 and an opposite side surface 432 having a lug 434, and a second opposite joining end 42 having a through hole 422 and on one side surface thereof 421 a C-shaped groove 423 having two ends 424,425.

Hook member 50 includes a wire hook 51 having a curved portion 511 and a straight portion 512, and a ring 52 having a hollowed center 522 and a ring body 521 having an irregular portion 523 having a through hole 524 radially passing straight portion 512 into center 522 where the free end of straight portion 512 is retained by a retainer 525.

Upper ends 12,22 of upper pieces 10,20 are limitedly pivotally connected together by central projection 123 which passes through central hole 222, protrusion 223 which engages C-shaped groove 124 and a screw 60 and two washers 61,62 which connect upper ends 12,22. Ring 52 is rotatably matched around raised portion 122 and between upper ends 12,22. Central projection 132 passed through hole 322, protrusion 133 engages in C-shaped groove 323 and a screw 63 and a washer 64 connect together lower end 13 and connecting end 32 so that ends 13,32 are limitedly pivotally connected together. Second joining end 42 is limitedly pivotally connected to lower engaging end 23 in that central projection 232 passes through hole 422, protrusion 233 engages in C-shaped groove 423 and a screw 65 and a washer 66 join ends 42,23.

As shown in FIG. 2, a normal triangular hanger is formed by the present hanger in which protrusion 223 urges against groove end 126 so that upper pieces 10,20 include therebetween an angle, protrusion 133 urges against groove end 325 so that upper and lower pieces 10,30 include therebetween an angle smaller than 90 degrees, protrusion 233 urges against groove end 424 so that upper and lower pieces 20,40 include therebetween an angle smaller than 90 degrees, and protrusion 433 engages in recess 332 so that lower pieces 30,40 construct a straight side.

Figure 3:
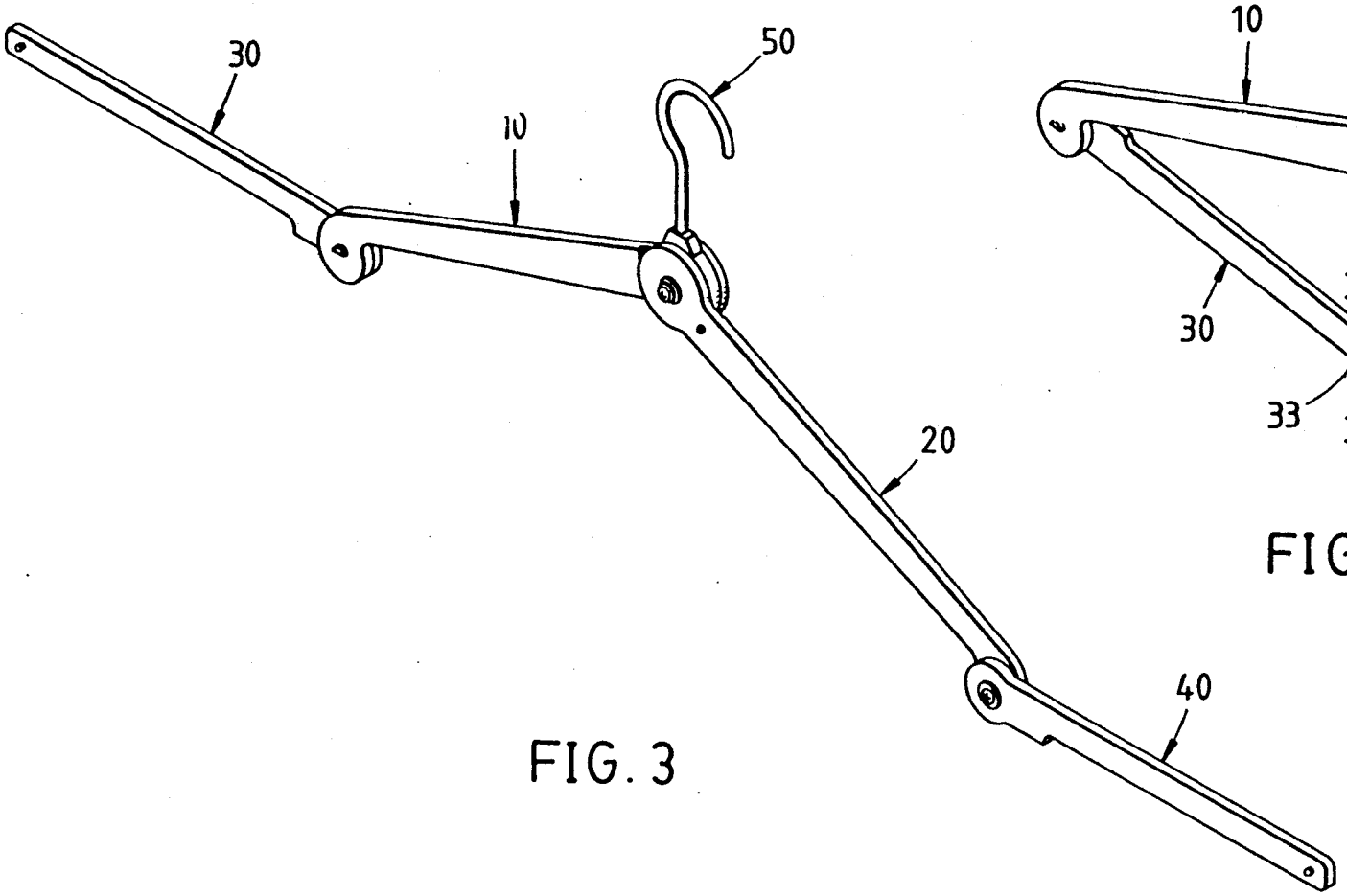
FIG. 3 is a perspective view of the hanger of FIG. 1 in a stretched configuration.
Figures 1, 1A, 1B:
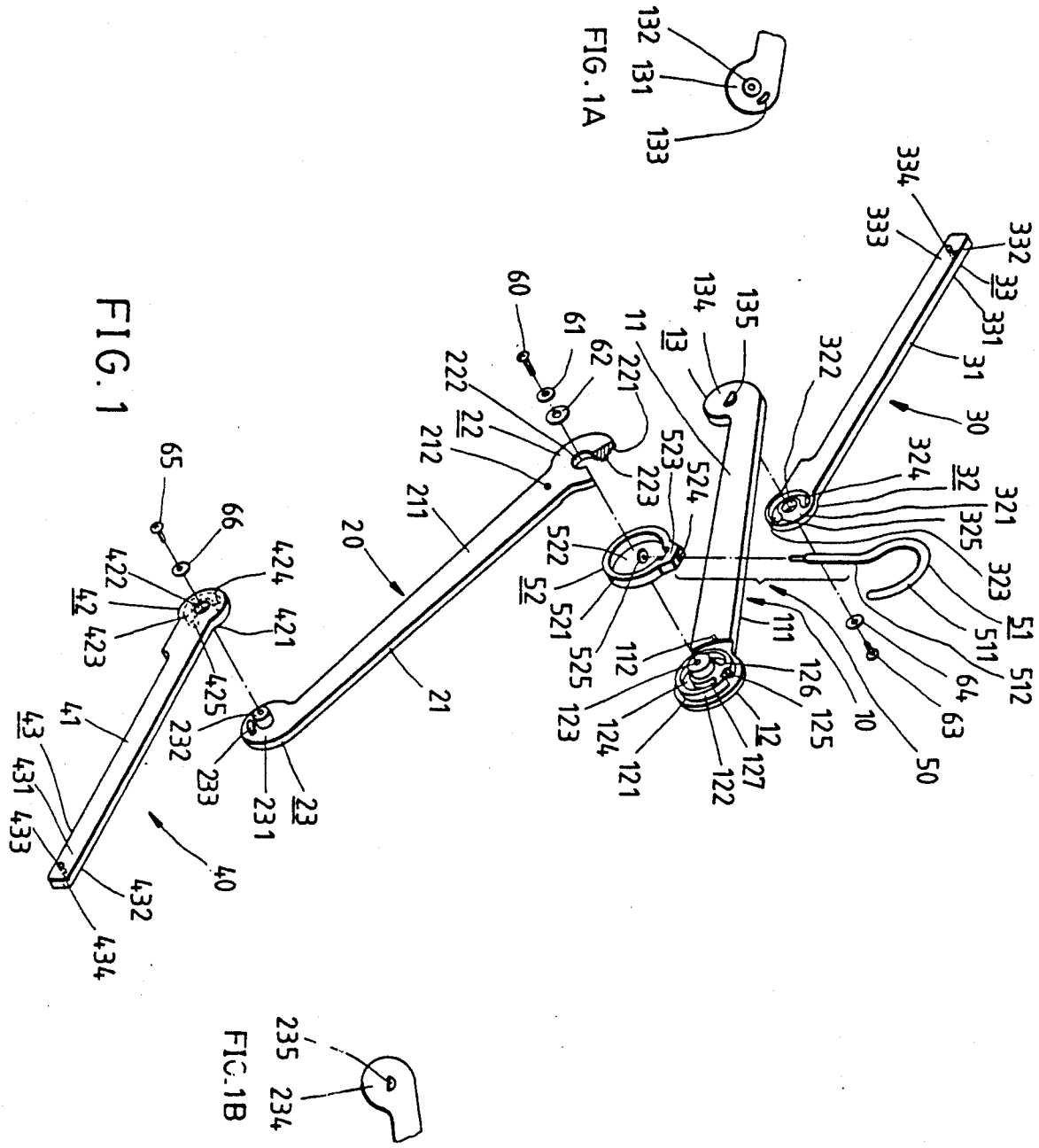
FIG. 1 is an exploded view showing a preferred embodiment of a collapsible hanger according to the present invention.
FIG. 1A is a plan view of a rear side of a lower engaging end of a first upper piece of a collapsible hanger of FIG. 1.
FIG. 1B is a plan view of a rear side of a lower engaging end of a second upper piece of a collapsible hanger of FIG. 1.

As shown in FIG. 3, the present hanger can have a stretched form in which protrusion 133 urges against end 324 so that upper and lower pieces 10,30 include therebetween an angle smaller than 180 degrees but larger than 90 degrees and protrusion 233 urges against groove end 425 so that upper and lower pieces 20,40 include therebetween an angle smaller than 180 degrees but larger than 90 degrees.

Figure 4:
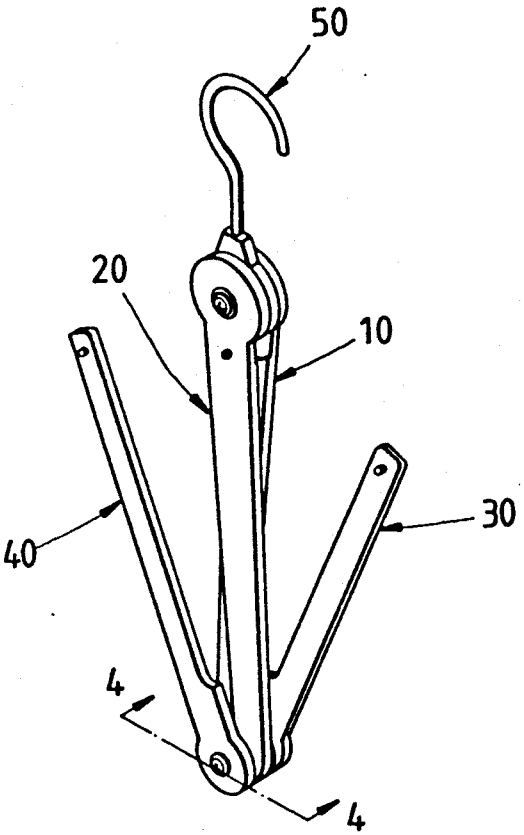
FIG. 4 is a perspective view of a hanger of FIG. 1 in a W configuration.
Figure 9:
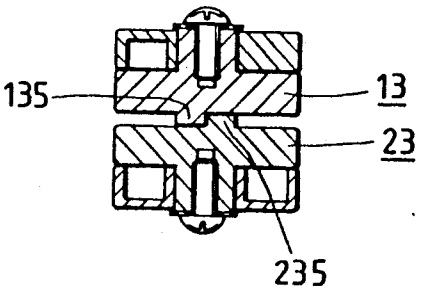
FIG. 9 is a sectional view taken along line 4—4 of FIG. 4.
Figure 6:
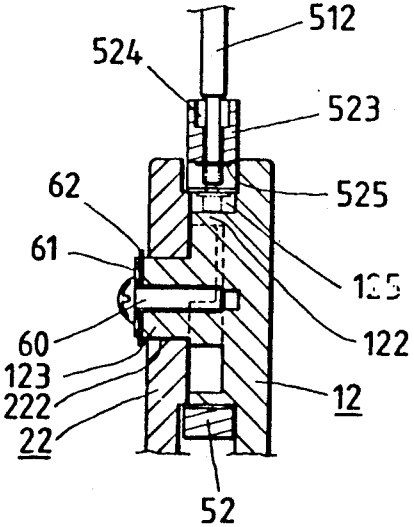
FIG. 6 is a sectional view taken along line 1—1 of FIG. 2.
Figure 8:
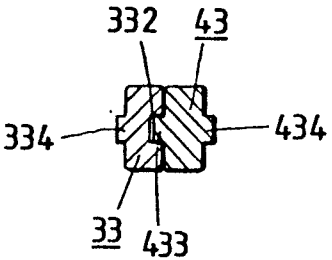
FIG. 8 is a sectional view taken along line 3—3 of FIG. 2.

As shown in FIGS. 4 and 9, the present hanger can serve as a W-shaped hanger to hang thereon a pair of gloves, shoes or the like, in which protrusion 223 urges against groove end 127 so that upper pieces 10,20 overlap with each other and central protrusions 135, 235 of lower engaging ends 13,23 urge against each other to prevent the present hanger from tending to form a triangular hanger as shown in FIG. 2.

Figure 5:
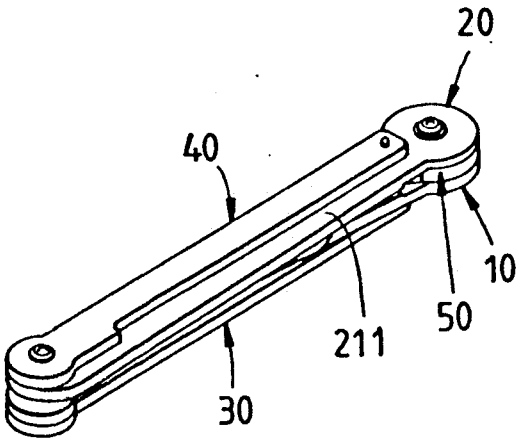
FIG. 5 is a perspective view of a hanger of FIG. 1 fully collapsed.
Figure 7:
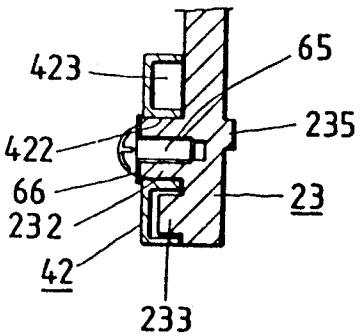
FIG. 7 is a sectional view taken along line 2—2 of FIG. 2.

FIG. 5 shows that the present hanger is collasped in which lower piece 30 is pivoted with respect to upper piece 10 to engage lug 334 in indentation 112, lower piece 40 is pivoted with respect to upper piece 20 to engage lug 434 in indentation 212 and ring 52 is rotated with respect to upper ends 12,22 to position wiry hook 51 between upper pieces 10,20.

What I claim is:

1. A collapsible hanger comprising:

a first upper piece;

said first upper piece including a first upper engaging end and an opposite first lower engaging end;

said first upper engaging end having a centrally-located projection;

a C-shaped groove in said first upper engaging end;

said C-shaped groove including an angle of more than 180, and less than 360 degrees; a lug on said first lower engaging end;

a second upper piece;

said second upper piece including a second upper engaging end pivotally mounted on said first upper engaging end;

an opposite lower engaging end on said second upper piece;

a lug on said opposite lower engaging end;

a first lower piece;

a first connecting end on said first lower piece;

an opposite second connecting end on said first lower piece;

said first connecting end having a first side surface;

a recess in said first side surface;

an opposite side surface on said first connecting end;

a lug on said opposite side surface;

said opposite second connecting end having a centrally-located through hole;

a C-shaped groove in said opposite second connecting end;

means for rotatably mounting said first connecting end on said first lower piece to said opposite first lower engaging end with said lug on said first lower engaging end engaging said C-shaped groove in said opposite second connecting end;

a second lower piece;

said second lower piece having a first joining end and an opposite second joining end;

said first joining end having a first surface;

a protrusion on said first side surface;

an opposite side surface on said opposite second joining end;

said opposite second joining end having a centrally-located through hole;

a C-shaped groove about said centrally-located through hole;

means for rotatably affixing said first joining end of said second lower piece to said opposite lower end on said second upper piece with said lug on said opposite lower end engaging said C-shaped groove about said centrally located through hole;

a hook member;

said hook member including a wire hook affixed to a ring; and said ring being affixed to said first upper piece and said second upper piece.

2. A collapsible hanger according to claim 1, wherein:

said wire hook includes a curved portion and a straigth portion;

said ring includes a ring body surrounding a hollow center;

said ring body surrounding said centrally-located projection in said first upper engaging end of said first upper piece; and said ring body being rotatable about said centrally-located projection, whereby said wire hook may rotate with respect to a remainder of said collapsible hanger.

3. A collapsible hanger according to claim 2, wherein:

said ring body includes an irregular portion;

a through hole vertically disposed in said irregular portion; and said straight portion of said wire hook passing through said through hole.

4. A collapsible hanger comprising:

first and second upper pieces;

one of said first and second upper pieces including a first C-shaped groove therein;

the other of said first and second upper pieces including a first lug engaging said first C-shaped groove;

means for permitting relative pivoting of said first and second upper pieces, whereby said first lug is movable along said first C-shaped groove;

said first C-shaped groove having an angular dimension constraining pivoting of said first and second upper end pieces between first and second angular positions;

said first angular position being a folded position;

said second angular position being an extended operational position;

a first lower piece;

said first upper piece including a first lower engaging end;

a second engaging end on said first lower piece;

a second C-shaped groove in one of said first lower engaging end and said second engaging end;

a second lug on the other of said first lower engaging end and said second engaging end;

said additional protrusion on said first upper piece engaging said second C-shaped groove;

said second C-shaped groove constraining relative rotation of said first lower piece with respect to said first upper piece between third and fourth relative angular positions;

a second lower piece;

said second upper piece including a second lower engaging end;

a third engaging end on said second lower piece;

a third C-shaped groove in one of said second lower engaging end and said third engaging end;

a third lug on the other of said second lower engaging end and said third engaging end;

said additional protrusion on said second upper piece engaging said third C-shaped groove;

said third C-shaped groove constraining relative rotation of said second lower piece with respect to said second upper piece between fifth and sixth relative angular positions.

and means for suspending said collapsible hanger.

5. A collapsible hanger according to claim 4, further comprising:

said first and second lower pieces each including an outer end; and means for engaging said outer ends of said first and second lower pieces to form a triangular shape with said first and second upper pieces.

6. A collapsible hanger according to claim 4, wherein: said fourth and sixth angular positions are extended positions, wherein said first and second lower pieces are extended and locked in an outward direction for hanging clothes thereon, when said first and second upper pieces are in their second angular position.

7. A collapsible hanger according to claim 4, wherein: said third and fifth angular positions are partly extended positions, wherein said first and second lower pieces are partly extend an locked in an outward direction for hanging clothes thereon, when said first and second upper pieces are in their first angular position.

8. A collapsible hanger according to claim 4, wherein means for suspending hanger comprise:

a ring;

said ring including a hollow center;

means for rotatably fitting said hollow center concentric with said first C-shaped groove; and a wire hook engaging said ring.

9. A collapsible hanger according to claim 8, further comprising means for permitting said wire hook to fit within said collapsible hanger when said collapsible hanger is collapsed.

* * * * *